United States Patent [19]

Shores

[11] Patent Number: 4,558,918

[45] Date of Patent: Dec. 17, 1985

[54] CABLE SHIELD TO CONNECTOR TERMINATION DEVICE

[75] Inventor: Marvin W. Shores, Pomona, Calif.

[73] Assignee: General Dynamics Pomona Division, Pomona, Calif.

[21] Appl. No.: 675,790

[22] Filed: Nov. 28, 1984

[51] Int. Cl.[4] ..... H01R 13/658

[52] U.S. Cl. ..... 339/143 R; 29/876; 339/177 R

[58] Field of Search ..... 339/177 R, 177 E, 143 R, 339/14 R; 174/35 R, 35 C, 78, 88 C; 29/874, 876

[56] References Cited

U.S. PATENT DOCUMENTS

| | | | |
|---|---|---|---|
| 2,036,203 | 4/1936 | Engel | 250/33 |
| 2,487,547 | 11/1949 | Harvey | 178/44 |
| 2,652,534 | 9/1953 | Graham | 324/60 |
| 2,778,867 | 1/1957 | Janssen | 174/35 |
| 3,198,990 | 8/1965 | Katzin | 317/100 |
| 3,659,247 | 4/1972 | Chaney et al. | 339/21 R |
| 3,659,340 | 5/1972 | Giedd et al. | 29/627 |
| 4,086,427 | 4/1978 | Nasuta, Jr. et al. | 174/88 C |
| 4,109,222 | 8/1978 | Frano et al. | 335/35 C |
| 4,148,543 | 4/1979 | Shores | 339/143 R |
| 4,276,523 | 6/1981 | Boutros et al. | 339/143 R |
| 4,374,881 | 2/1983 | Hamilton | 428/36 |
| 4,382,653 | 5/1983 | Blanchard | 339/143 R |

FOREIGN PATENT DOCUMENTS

| | | | |
|---|---|---|---|
| 914498 | 1/1963 | United Kingdom | 38/1 |
| 2120467 | 11/1983 | United Kingdom | 339/143 R |

*Primary Examiner*—John McQuade

*Attorney, Agent, or Firm*—Neil F. Martin; Calif K. Tervo; Edward B. Johnson

[57] ABSTRACT

A cable shield to connector back shell termination device includes a back shell of a multi-pin cable connector, a plurality of metallic tubes adapted to receive individually the end of a shielded cable such that substantially full circumferential conductive contact is maintained between each cable shield and a tube, and a cluster of such tubes conductively bonded together and shaped to fit the back shell for conductive bonding to the back shell. A second embodiment employs a conductive sleeve for conductive mounting on the cable shield. Ridges or fins extending generally lengthwise on the sleeve frictionally, conductively contact the metal tubes. In this manner an uninterrupted conductive surface is maintained at the connector. The connector enclosure thus provides a shield against the intrusion of electromagnetic energy in the environment in which the electrical or electronic wiring and circuits must operate.

7 Claims, 11 Drawing Figures

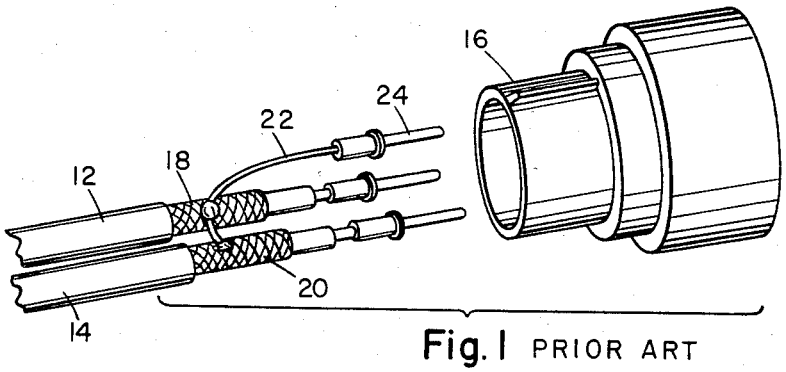
Fig. 1 PRIOR ART
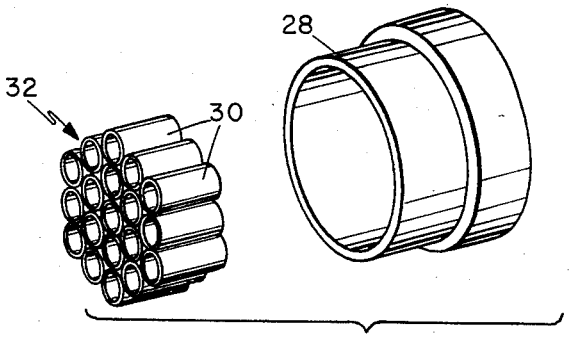
Fig. 2
Fig. 3
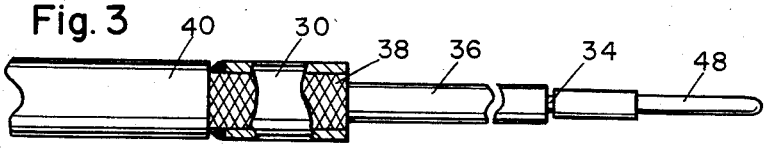
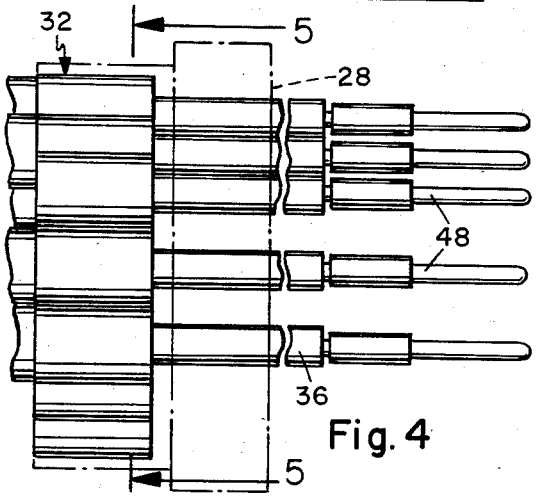
Fig. 4
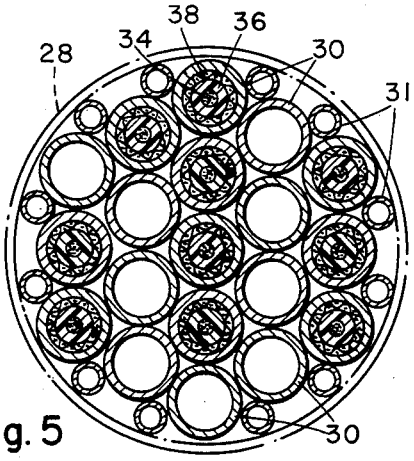
Fig. 5

CABLE SHIELD TO CONNECTOR TERMINATION DEVICE

BACKGROUND OF THE INVENTION

1. Field of the Invention

This invention relates in general to multi-pin, shielded cable connectors and, more specifically, to a device for terminating the cable shield to the connector back shell.

2. Background of the Invention

Electrical and electronic wiring and circuits designed for operation in a relatively strong electromagnetic environment generally require an enclosure having an uninterrupted conductive surface. Such an enclosure is called a "shield." Unless an opening or aperture in the shield is of a special configuration, it will seriously degrade the effectiveness of the shield.

Maintaining a shielded enclosure around a system made up of separate units or sub-assemblies require connectors between the shield cables. Generally, a single connector houses several shielded cables that are grouped together as a larger cable.

Conventionally, the method in terminating a cable shield to its connector is to cut and trim the shield, solder on a wire, or "pigtail," and connect the shield to a dedicated pin terminal. Another similarly configured pin terminated in the mating connector mates with this terminal to connect the shields.

There are a number of disadvantages to prior art methods. The practice illustrated above almost invariably exposes the cables to the electromagnetic environment, thus degrading the entire system enclosure. Also, prior art methods are not readily adaptable to automatic production techniques.

Therefore, it is desirable to have cable shield termination device that does not introduce any significant loss of shielding integrity. It is further desirable that such a device be applicable to automated mechanical assembly methods.

SUMMARY OF THE INVENTION

This invention is a cable shield to connector back shell termination device for receiving the end of a shielded cable and it generally comprises the back shell of a multipin cable connector, a plurality of metallic tubes adapted to individually receive the end of a shielded cable such that substantially full circumferential conductive contact is maintained between each cable shield and a tube, and a cluster of such metallic tubes conductively bonded together and shaped to fit the back shell for conductive bonding to the back shell. Empty filler tubes may be added to the tube cluster for ensuring a tight fit within the back shell. The tubes may be pre-tinned and bonded to the back shell by a method such as induction soldering.

According to a further precept of the invention, the conductive connection between the cable shield and the tube is further enhanced by the use of a conductive sleeve. The conductive sleeve flips over and forms a conductive contact with the cable shield. A plurality of ridges, spaced around the periphery of the sleeve, provide frictional conductive contact with a metal tube.

Other features and many attendant advantages of the invention will become more apparent upon a reading of the following detailed description together with the drawings, in which like reference numerals refer to like parts throughout.

BRIEF DESCRIPTION OF THE DRAWINGS

FIG. 1 illustrates a prior art technique for electrically connecting the shields of shielded cables to a connector back shell.

FIG. 2 is a perspective view of a metallic tube cluster and solder ring in accordance with the present invention.

FIG. 3 is an enlarged side elevation view, mostly cut away, of the end of a single shielded cable with the metallic tube attached.

FIG. 4 is a side elevation view of an assembled tube cluster and cables.

FIG. 5 is a sectional view taken along line 5—5 of FIG. 4.

DETAILED DESCRIPTION OF THE INVENTION

Figure 6:
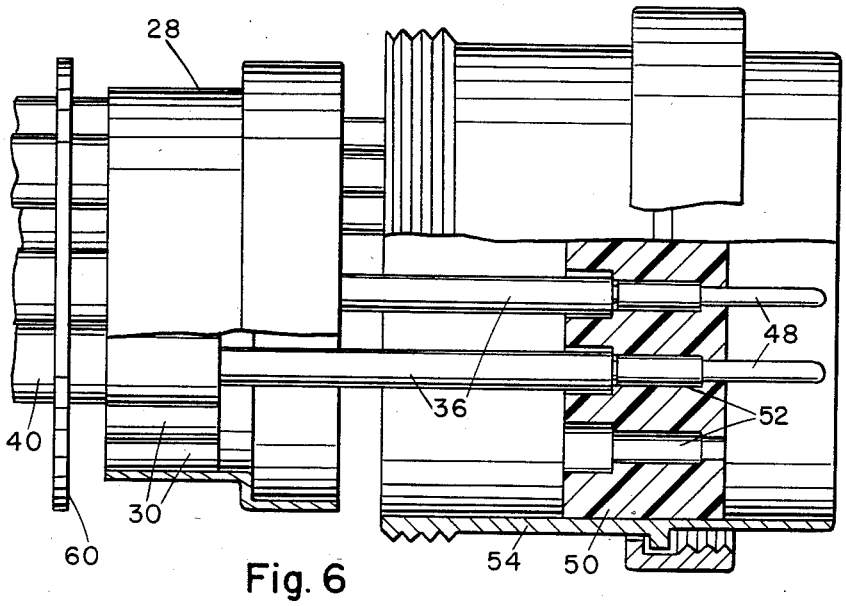
FIG. 6 is a side elevation view partially in section of a partially assembled connector.

With reference now to the drawing, FIGS. 2–7 show an exemplary embodiment of the device of the present invention, and FIGS. 8–11 show an alternative exemplary embodiment.

With reference now to FIG. 3, there is shown a shielded cable as being prepared for insertion into a connector. The shielded cable comprises a central conductor 34 with surrounding insulation 36, and a braided wire shield 38 with outer insulation 40 covering the shield 38. The cable is trimmed with the shield 38 trimmed and exposed to receive a metallic sleeve or tube 30, which is fitted in substantially full circumferential conductive contact with the braided wire shield 38. The braided wire shield 38 and each tube 30 may be pre-tinned, such as by means of a suitable solder. The cable is also trimmed to allow attachment of an appropriate pin or socket terminator 48 to the central conductor 34. A pin connector is shown in the drawings. The pin or socket terminator 48 is commonly attached with a solder bond.

Figure 7:
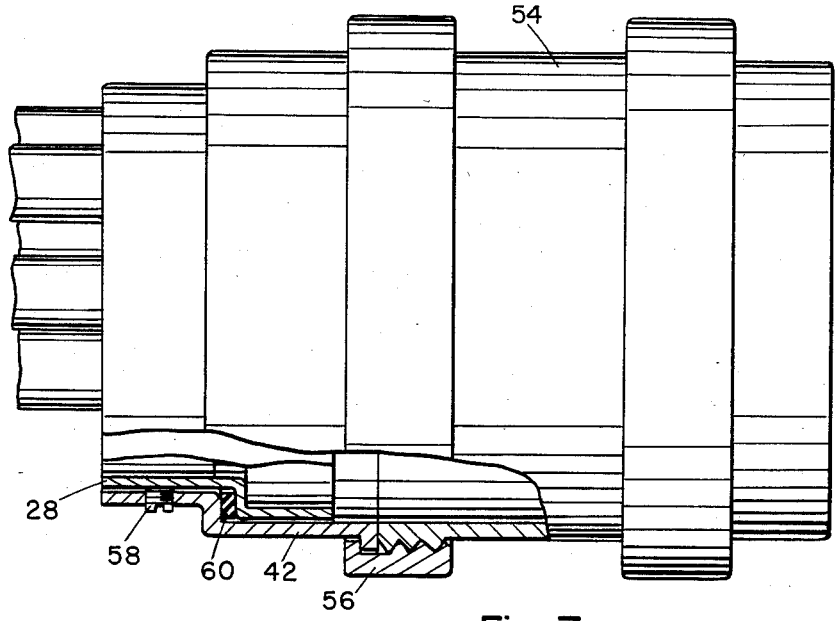
FIG. 7 is a view like FIG. 6 of an assembled connector.

Once each of the shielded cables is prepared in this manner, all of the cables are inserted consecutively through the bore of a ring nut 56, an adapter ring 42, and a conductive gasket 60, as shown in FIGS. 6 and 7. As shown in FIGS. 2, 4, and 7, the metal tubes 32, when fitted on the braided wire shield 38, are formed into a cluster 30 for fitting into a solder ring 28, which is selected for mating with the adapter ring 42.

FIG. 5 is a sectional view of the tubes 32 in the solder ring 28 taken along line 5—5 of FIG. 4. Extra empty tubes 31 are added to the tube cluster 30, as required, to ensure a tight fit and proper placement of the wires within the solder ring 28. All of the tubes 30, 31, 32 are bonded together and to the solder ring 28 by induction soldering to ensure a contiguous conductive surface.

As shown in FIG. 6, each of the connector pins 48 is then inserted into a connector body 50 in a selected bore 52 therein. The connector body 50 is a dielectric and is mounted in a connector body shell 54.

As illustrated in FIG. 7, the connector shell 54, the solder ring 28, the conductive gasket 60, and the adapter ring 42 are brought together and then held in assembly by the ring nut 56. A moisture sealant is injected into the back of the adapter ring 42 to close the openings around the wires. The conductive gasket 60 seals the gap between the solder ring 28 and the adapter ring 42. The solder ring 28 is secured to the adapter ring 42, such as by a plurality of screws 58.

This structure completes one-half of a connector assembly in accordance with the invention. The other half of the connector assembly would be constructed similarly but would have the mating terminals 48.

In this manner, a cable shield is terminated to a connector such that the enclosure has an ininterrupted conductive surface. Thus, the central conductors are not unduly exposed to external electromagnetic energy.

Figure 8:
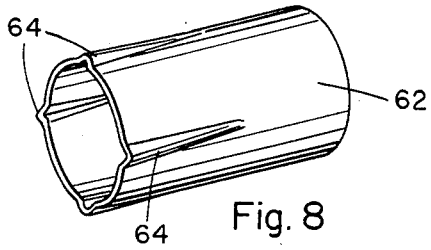
FIG. 8 is a perspective view of a connector sleeve for cable shield to metallic tube connection.
Figure 9:
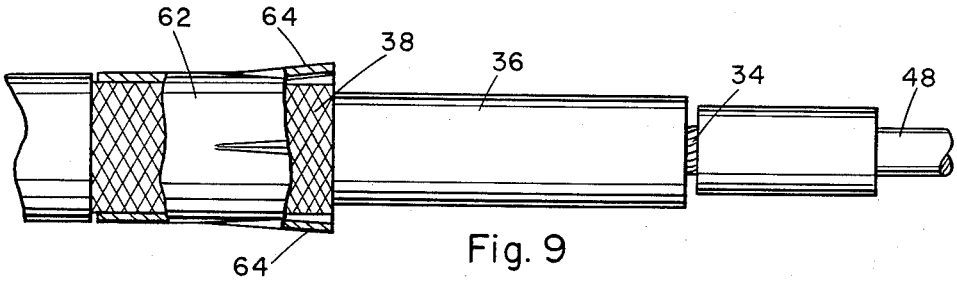
FIG. 9 is a view like FIG. 3 showing the connector sleeve in place on a cable shield.

Referring now to FIGS. 8–11, an alternative embodiment of the invention is illustrated, wherein the connection of the cables to the tube cluster is by means of a friction connector rather than by direct bonding, as in the previous described embodiment. In this embodiment the cables are prepared in a manner such that the connection between a cable shield and a tube of the termination device, which acts as an electromagnetic attenuator, is such that a friction coupling is provided to permit easy removal and replacement of the cables, the coupling, or both. Referring particularly to FIG. 8, the connector sleeve 62 is of a generally cylindrical configuration and has a plurality of radially extending ridges 64, formed such as by crimping a portion of the sleeve 62 beginning approximately midway thereof and terminating at one end. The ridges 64 form a slope or ramp configuration, with increasingly greater radial height from the approximate center of the axial link of the connector sleeve 62 to one end. The sleeve 62 is sized and shaped to fit snugly over the braided wire shield 38 of the cable. The connector sleeve 62 is of a conductive material, such as copper, a copper alloy, or other metal. In the preferred embodiment, the connector sleeve 62 is bonded directly to the braided wire shield 38, such as by means of a conductive adhesive, such as solder. FIG. 9 shows a trimmed cable with a terminator 48 and a connector sleeve 62 attached. The connector sleeve 62 is partially cut away to show its structure.

Figure 10:
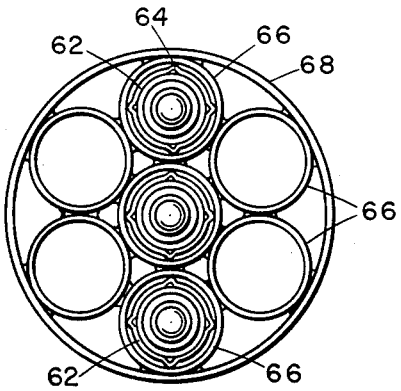
FIG. 10 is a view like FIG. 5 showing an alternate embodiment incorporating the connector sleeve of FIG. 8 as a conductive intermediary between the cable shield and the metallic tube.
Figure 11:
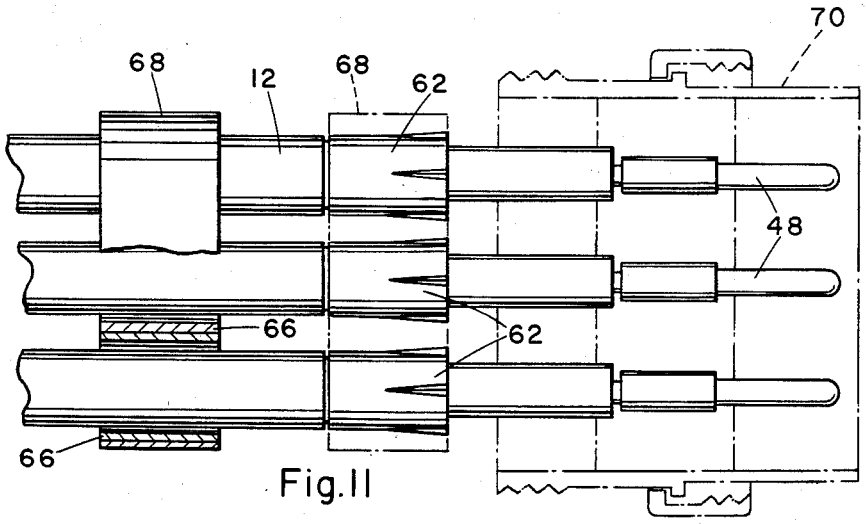
FIG. 11 is a side elevation view partially in section, of the embodiment of FIG. 10 partially assembled.

As illustrated in FIG. 10, a plurality of conductive tubes 66 are mounted in a cluster inside a ring 68 and are conductively bonded to each other and to the ring 68. The tubes 66 are of an appropriate size to receive the connector sleeves 62 with a frictional fit on the radially extending ridges 64.

This embodiment of the cable shield to connector termination device is assembled in a manner similar to the first described embodiment above, except for the procedures described below. The tubes 66 are bonded to the ring 68. The cables are threaded through this assembly, then the connector sleeves 62 are added as in FIG. 9, resulting in the full line position shown in FIG. 11. When all of the cables are properly seated, the ring 68 is slid forward so that the tubes 66 seat on the sleeves 62 with electrical continuity. The ring 68 may then be secured in a manner as set forth in the first embodiment.

This provides an assembly wherein electromagnetic propagation within or in either direction through any unused tube or sleeve of the cylindrical cluster will be significantly attenuated at frequencies below the wave guide cutoff frequency. The tubes in this case act as wave guides. The cutoff frequency of a circular or cylindrical wave guide is 6920/g megahertz, where g is the tube diameter in inches. The appropriate attenuation of a cylindrical tube is $32 \times L/g$ decibels where L equals the length of the tube in inches. Thus, the appropriate attenuation may be achieved by selecting tubes of proper dimension. The major cross-section dimension of the odd-shaped spaces between the tubes 30 and solder ring 28 should not exceed the diameter of the tube. Therefore, small filler tubes 31 may be inserted in the spaces, as in FIG. 5, to provide the desired attenuation characteristics. The unused tubes may be closed, if desired.

This termination device prevents the exposure of the inner conductor of a shielded wire cable to possible interference. The shield termination device inherently attenuates due to its tubular design and therefore prevents potential interference energy from entering or escaping the enclosure.

The tube method of shield termination and connection is adaptable to automated attachment techniques.

The invention has been shown and described with reference to certain specific embodiments; however, it is to be understood that modifications and substitutions can be made by a person skilled in the art without departing from the spirit and scope of the invention as described in the appended claims.

I claim:

1. A cable shield to connector back shell termination device for receiving the end of a shielded cable, said device comprising:

a back shell of a multi-pin cable connector;

a cluster of a multiple of metallic tubes conductively bonded together and shaped to fit said back shell for conductive bonding to said back shell;

a plurality of said tubes adapted to receive individually the ends of a shielded cable such that substantially full circumferential conductive contact is maintained between each cable shield and its tube; and means for conductive connection of each cable shield with a corresponding tube;

wherein said means for connection comprises:

a conductive sleeve for conductive mounting on said cable shield and for conductive frictional engagement with said tube.

2. The termination drive of claim 1 wherein said sleeve is generally cylindrical in shape and has contact ridges based around the periphery thereof.

3. The termination device of claim 2 wherein:

said contact ridges are formed by crimping said conductive sleeve.

4. The termination device of claim 2 wherein:

said contact ridges extend generally lengthwise on said sleeve and have a generally inclined plane configuration.

5. A method of establishing a shielded termination between a cable shield and a connector back shell of a multi-pin connector; said method comprising the steps of:

selecting a plurality of conductive tubes adapted for individually receiving the ends of a shielded cable;

mounting a shielded cable in at least one of said tubes;

establishing a conductive connection between the cable shield and said tube; including:

mounting a connector sleeve in a conductive relationship with said cable shield; and mounting said sleeve in a frictional conductive relationship with said tube;

mounting said tubes in a back shell of a multi-pin connector;

establishing a conductive between said tubes; and establishing a conductive connection between said tubes and said back shell.

6. The method of claim 5 wherein:

the step of mounting said sleeve in a frictional conductive relationship with said tube includes: selecting a sleeve having a plurality of contact ridges spaced around the periphery thereof.

7. The method of claim 6 wherein the step of selecting a sleeve further includes:

selecting a sleeve having contact ridges formed by crimping.

* * * * *